US011108129B2

(12) United States Patent
Leung et al.

(10) Patent No.: US 11,108,129 B2
(45) Date of Patent: Aug. 31, 2021

(54) ANTENNA ASSEMBLY

(71) Applicant: City University of Hong Kong, Kowloon (HK)

(72) Inventors: Kwok Wa Leung, Kowloon Tong (HK); Lei Guo, Kowloon Tong (HK); Kim Fung Tsang, Kowloon Tong (HK)

(73) Assignee: City University of Hong Kong, Kowloon (HK)

( * ) Notice: Subject to any disclaimer, the term of this patent is extended or adjusted under 35 U.S.C. 154(b) by 518 days.

(21) Appl. No.: 16/003,167

(22) Filed: Jun. 8, 2018

(65) Prior Publication Data

US 2019/0379104 A1 Dec. 12, 2019

(51) Int. Cl.

| | |
|---|---|
| ***H01Q 1/12*** | (2006.01) |
| ***H01Q 13/10*** | (2006.01) |
| ***H01Q 9/04*** | (2006.01) |
| ***H01Q 1/44*** | (2006.01) |

(52) U.S. Cl.
CPC ..... *H01Q 1/1221* (2013.01); *H01Q 9/0485* (2013.01); *H01Q 13/10* (2013.01); *H01Q 1/44* (2013.01)

(58) Field of Classification Search
CPC ..... H01Q 1/1221; H01Q 9/0485; H01Q 1/46
See application file for complete search history.

(56) References Cited

U.S. PATENT DOCUMENTS

| | | | | |
|---|---|---|---|---|
| 8,987,061 | B2 | 3/2015 | Lee et al. | |
| 9,123,995 | B2 | 9/2015 | Leung et al. | |
| 2009/0153403 | A1* | 6/2009 | Chang | H01Q 9/0492 343/700 MS |
| 2013/0249757 | A1* | 9/2013 | Leung | H01Q 9/0485 343/785 |
| 2014/0213199 | A1 | 7/2014 | Perten | |
| 2015/0349427 | A1* | 12/2015 | Camden | H04L 12/282 343/702 |

FOREIGN PATENT DOCUMENTS

| | | |
|---|---|---|
| CN | 203966214 | 6/2014 |

* cited by examiner

*Primary Examiner* — Andrea Lindgren Baltzell
*Assistant Examiner* — Amal Patel
(74) *Attorney, Agent, or Firm* — Renner Kenner Greive Bobak Taylor & Weber

(57) ABSTRACT

An antenna assembly, a wireless-communication-enabled device and an intelligent home or office appliance including such antenna assembly. The antenna assembly includes an antenna including an antenna body and a feeder, and at least one functional module arranged to operate with a function different from that provided by the antenna.

22 Claims, 11 Drawing Sheets

ANTENNA ASSEMBLY

TECHNICAL FIELD

The present invention relates to an antenna assembly, and particularly, although not exclusively, to a multifunctional antenna assembly.

BACKGROUND

In a radio signal communication system, information is transformed to radio signal for transmitting in form of an electromagnetic wave or radiation. These electromagnetic signals are further transmitted and/or received by suitable antennas.

Some antennas may be designed to be housed within a casing of an electrical apparatus so as to provide a better appearance of such apparatus, however the performance of these built-in antennas may be degraded by an unavoidable shielding effect induced by the housing encapsulating the antennas and the internal components of the apparatus.

SUMMARY OF THE INVENTION

In accordance with a first aspect of the present invention, there is provided an antenna assembly comprising an antenna including an antenna body and a feeder, and at least one functional module arranged to operate with a function different from that provided by the antenna.

In an embodiment of the first aspect, the antenna body includes a dielectric resonator.

In an embodiment of the first aspect, the antenna is a dielectric resonator antenna.

In an embodiment of the first aspect, the antenna is arranged to operate in a dielectric resonator $TE_{2\delta 1}^{y}$ mode.

In an embodiment of the first aspect, the antenna is arranged to radiate an electromagnetic radiation including at least one of a broadside, an endfire, an omnidirectional and a conical-beam radiation pattern.

In an embodiment of the first aspect, the antenna includes a non-resonant-type antenna.

In an embodiment of the first aspect, the functional module is physically connected to the antenna body.

In an embodiment of the first aspect, the dielectric resonator is provided with at least one mounting structure arranged to mount the functional module thereon.

In an embodiment of the first aspect, the mounting structure is further arranged to at least partially accommodate or encompass the functional module.

In an embodiment of the first aspect, the mounting structure includes an aperture defined in the dielectric resonator.

In an embodiment of the first aspect, the dielectric resonator is a rectangular block of dielectric material.

In an embodiment of the first aspect, the dielectric material includes zirconia.

In an embodiment of the first aspect, the antenna body is at least partially transparent.

In an embodiment of the first aspect, the feeder includes a slot feeder.

In an embodiment of the first aspect, the slot feeder comprises a feeding slot structure defined on the antenna body.

In an embodiment of the first aspect, the feeding slot structure is defined in a positioned shifted from a center position of the antenna body.

In an embodiment of the first aspect, the slot feeder further comprises a microstripline or coaxial feedline adjacent to the feeding slot structure.

In an embodiment of the first aspect, the feeder includes at least one of a probe feed, a direct microstrip feedline, a coplanar feed, a dielectric image guide, a metallic waveguides and a substrate-integrated waveguide.

In an embodiment of the first aspect, the antenna further comprises a ground plane adjacent to the antenna body.

In an embodiment of the first aspect, the ground plane includes an electrical conductive sheet connected to the antenna body.

In an embodiment of the first aspect, the electrical conductive sheet includes a sheet of copper adhesive.

In an embodiment of the first aspect, the functional module includes an electrical switch.

In an embodiment of the first aspect, the antenna assembly is arranged to operate as a switch panel.

In an embodiment of the first aspect, the functional module includes an electrical power socket.

In an embodiment of the first aspect, the antenna body is arranged to form a part of an electrical apparatus.

In an embodiment of the first aspect, the electrical apparatus includes an intelligent home or office appliance.

In an embodiment of the first aspect, the electrical apparatus includes a wireless-communication-enabled device.

In accordance with a second aspect of the present invention, there is provided a wireless-communication-enabled device, comprising an antenna assembly in accordance with the first aspect, wherein the antenna is arranged to facilitate a communication between an external communication device and the wireless-communication-enabled device.

In accordance with a third aspect of the present invention, there is provided an intelligent home or office appliance, comprising the wireless-communication-enabled device in accordance with the second aspect or the antenna assembly in accordance with the first aspect.

BRIEF DESCRIPTION OF THE DRAWINGS

Embodiments of the present invention will now be described, by way of example, with reference to the accompanying drawings in which.

DETAILED DESCRIPTION

Figure 1A:
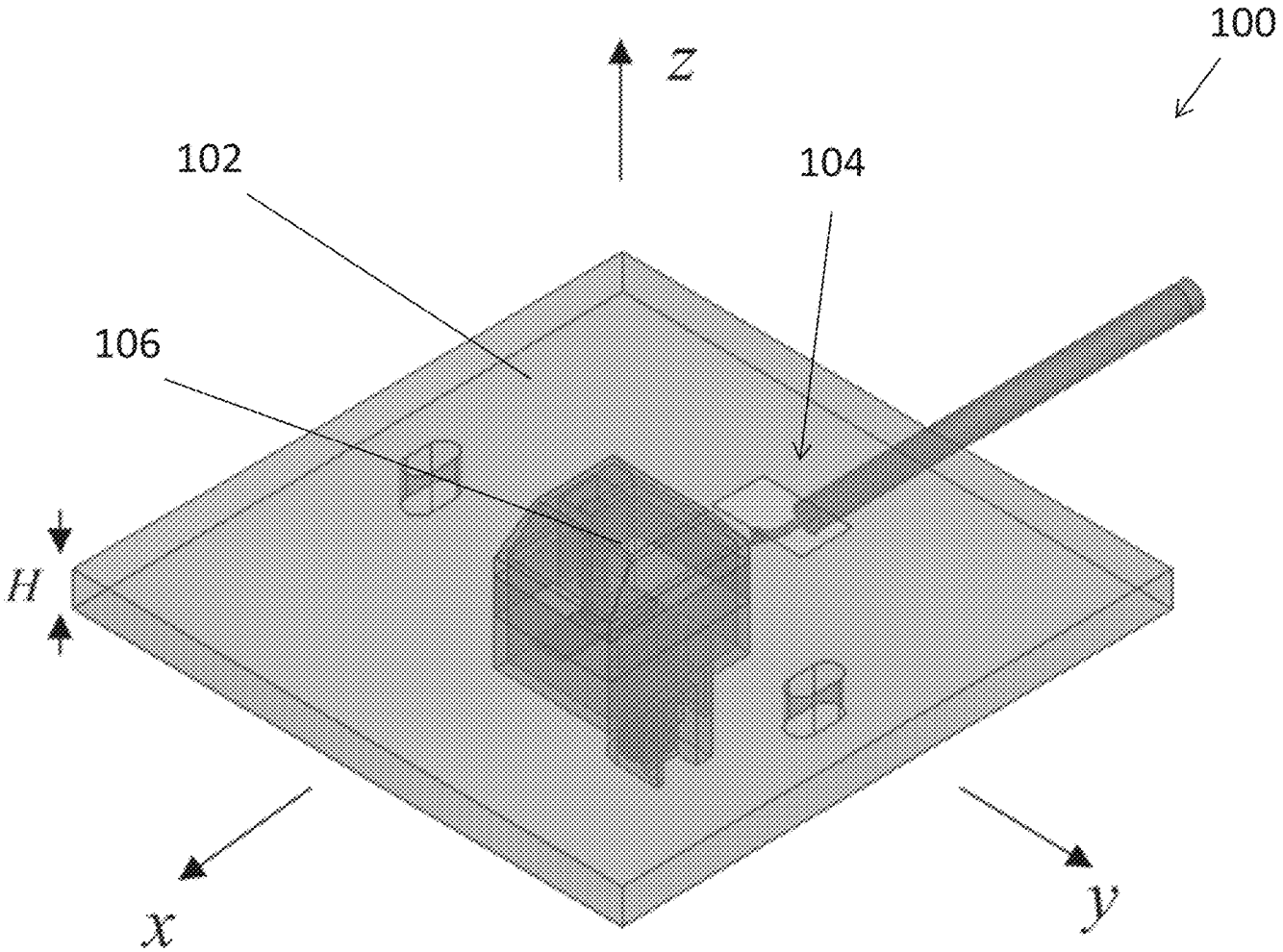
FIGS. 1A and 1B are a perspective view and a top view of an antenna assembly in accordance with one embodiment of the present invention.

The inventors have, through their own research, trials and experiments, devised that transparent antenna may be used in multifunctional element in automobiles or aircrafts, solar module, and mirror. In some example embodiments, the antennas may include planar structures using different transparent conductive materials, such as transparent conducting oxide (TCO) films, indium tin oxide (ITO), fluorine-doped tin oxide (FTC)), and silver coated polyester (AgHT). However, a compromise should be made in these transparent conducting materials between the transparency and the ohmic loss.

Alternatively, a 3-D transparent glass dielectric resonator (DR) antenna (DRA) may be used instead. The DRA may inherit a number of advantages such as compact size, low loss, high efficiency, and high degree of design flexibility. In one example embodiment, a transparent DRA may be made of K9 glass with a dielectric constant around 7 from 0.5 GHz to 3 GHz. Using the glass block, the gain and efficiency of the transparent antenna may be comparable with some typical designs of DRA. The transparent glass DRA may also be bundled with several functions for compactness, such as a focusing lens and protective cover (or encapsulations) for solar panels.

In some other embodiments, the transparent glass DRAs may also be used as a decorations, a light cover, and even a mirror.

In yet another embodiment, a transparent antenna-integrated socket panel may be used as an antenna and transparent socket panel, and an electromagnetic wave signal may be radiated by a slot etched on the ground plane of the antenna component.

In accordance with a preferable embodiment, there is provided a dual-function transparent DRA functioning as a switch panel for household wireless communications. Preferably, the transparent DR may be made of zirconia material that shows a dielectric constant around 28 from 2.0 GHz to 3.0 GHz. A DR mode electromagnetic signal may be excited for radiation by using an off-center located slot on the ground plane, and the switch DRA may operate at the WLAN band (2.4-2.48 GHz).

Figure 1B:
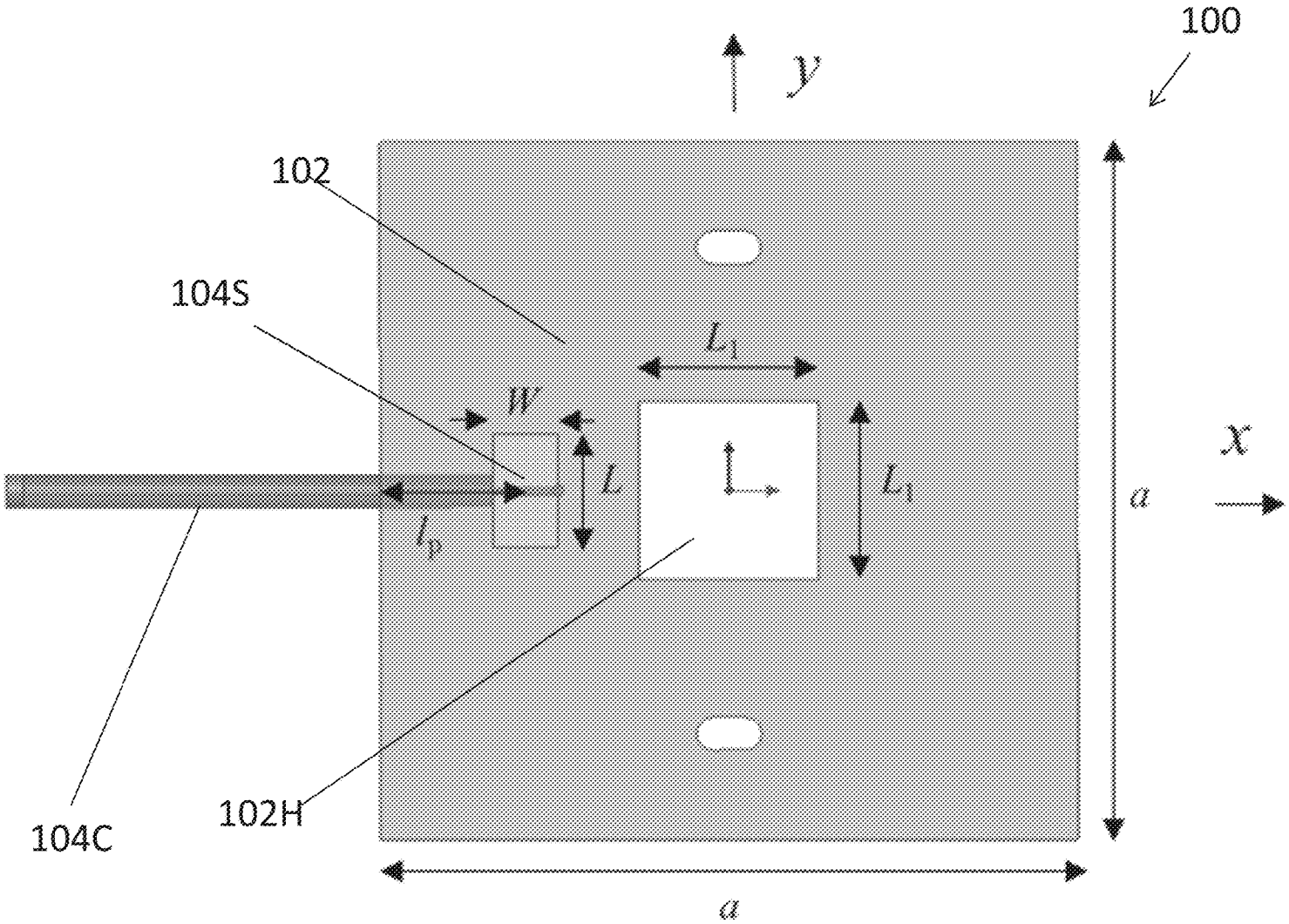

With reference to FIGS. 1A and 1B, there is shown an example embodiment of an antenna assembly 100 comprising an antenna including an antenna body 102 and a feeder 104, and at least one functional module 106 arranged to operate with a function different from that provided by the antenna.

In this embodiment, the antenna assembly 100 includes an antenna and an electrical switch 106 combined as an assembly, and may be used as an electrical switch panel, such as a switch panel which may be installed on a wall surface for switching electrical lighting in a room. The physical dimension of the switch panel 100 in this example may match with a typical switch panel, such that the antenna assembly 100 may retrofit existing structures therefore the existing switch panel may be conveniently replaced by the antenna assembly 100. By replacing the existing switch panel with the antenna assembly 100 in accordance with embodiments of the present invention, wireless communication function may be introduced to the environment without substantially modifying the existing infrastructure.

Preferably, the antenna body 102 includes a dielectric resonator (DR), and therefore the antenna may be provided as a dielectric resonator antenna (DRA). Preferably, the dielectric resonator 102 is provided as block of rigid material with certain volume and dimensions, which may also serve as a mechanical support for the functional module 106 of the antenna assembly 100 when the functional module 106 is physically connected to the antenna body 102 or the DR.

Preferably, the dielectric resonator 102 may also be provided with at least one mounting structure, such as an aperture, a cavity, or any suitable fastening structure, arranged to mount the functional module 106 thereon. The mounting structure may be used to accommodate or encompass at least a portion of the function module 106. Alternatively, the functional module 106 may be connected to the DR 102 via external fastening means or an engagement between mechanical structures provided on the functional module 106 and the fasten structure provided on the antenna body 102.

Referring to FIGS. 1A and 1B, there is shown a example configuration of the antenna assembly 100 or the dual-function switch DRA in accordance with an embodiment of the present invention. The dielectric resonator 102 is a rectangular block of dielectric material, which may be made of zirconia material with the dielectric constant of $\varepsilon_r$=28. It has a square shape with the side length of a=86 mm and height of H=5.4 mm.

The antenna further comprises a ground plane adjacent to the antenna body 102. The ground plane may be an electrical conductive sheet placed adjacent or connected to the antenna body 102. In one example embodiment, the ground plane may be provided by placing a sheet of adhesive copper tape on the bottom side of the panel. In this example, the ground plane includes a dimension which is substantially the same as the panel surface of the antenna body or the DR 102.

Alternatively, the dielectric material includes other types of material, such as but not limited to silicon dioxide, acrylic and porcelain, or any material which is at least partially transparent. Alternatively, non-transparent DR material may be used in some other example embodiments.

For placing the switch button 106, a small square region with the side length of $L_1$=22 mm is removed from both the panel and ground, thereby defining an aperture 102H in the dielectric resonator 102.

In order to excite the switch panel 100 or the DR 102, the antenna may be fed by a slot feeder 104. In this example, an off-center slot with a dimension of L×W=14 mm×8 mm is etched at a distance of $l_p$=25 mm from the panel edge, thereby forming a feeding slot structure 104S positioned shifted from a center position (or a centroid) of the antenna body 102.

The slot 104S is fed by a coaxial cable 104C placed in the center of the slot 104S. Alternatively, the slot feeder 104 further comprises a microstripline or coaxial feedline adjacent to the feeding slot structure, or the feeder 104 may include other types of feeder, such as but not limited to a probe feed, a direct microstrip feedline, a coplanar feed, a dielectric image guide, a metallic waveguides and a substrate-integrated waveguide.

In addition, the switch panel 100 is designed according to other typical switch panel, except with a lower height as the resonant frequency of the antenna is determined by the height of the antenna body 102 if the side lengths are fixed. Besides, the lower height may reduce the weight of the assembly 100 which may make it more favourable in some desired applications.

In some alternative embodiments, the functional module includes an electrical power socket, such that the power socket panel may also operate as a wireless component of an electrical appliance. The antenna body 102 may alternatively form a part of an electrical apparatus including a wireless-communication-enabled device, for example the antenna body 102 may form a part of the housing of a wireless router, which may also operate as an antenna for radiating WiFi signal to facilitate a communication between an external communication device and the router.

The inventors have carried out parametric studies to investigate the operating mode of the antenna assembly 100 or the switch DRA in accordance with an embodiment of the present invention. The center switch button was removed from the panel so as to simplify the parametric analysis.

Figure 2:
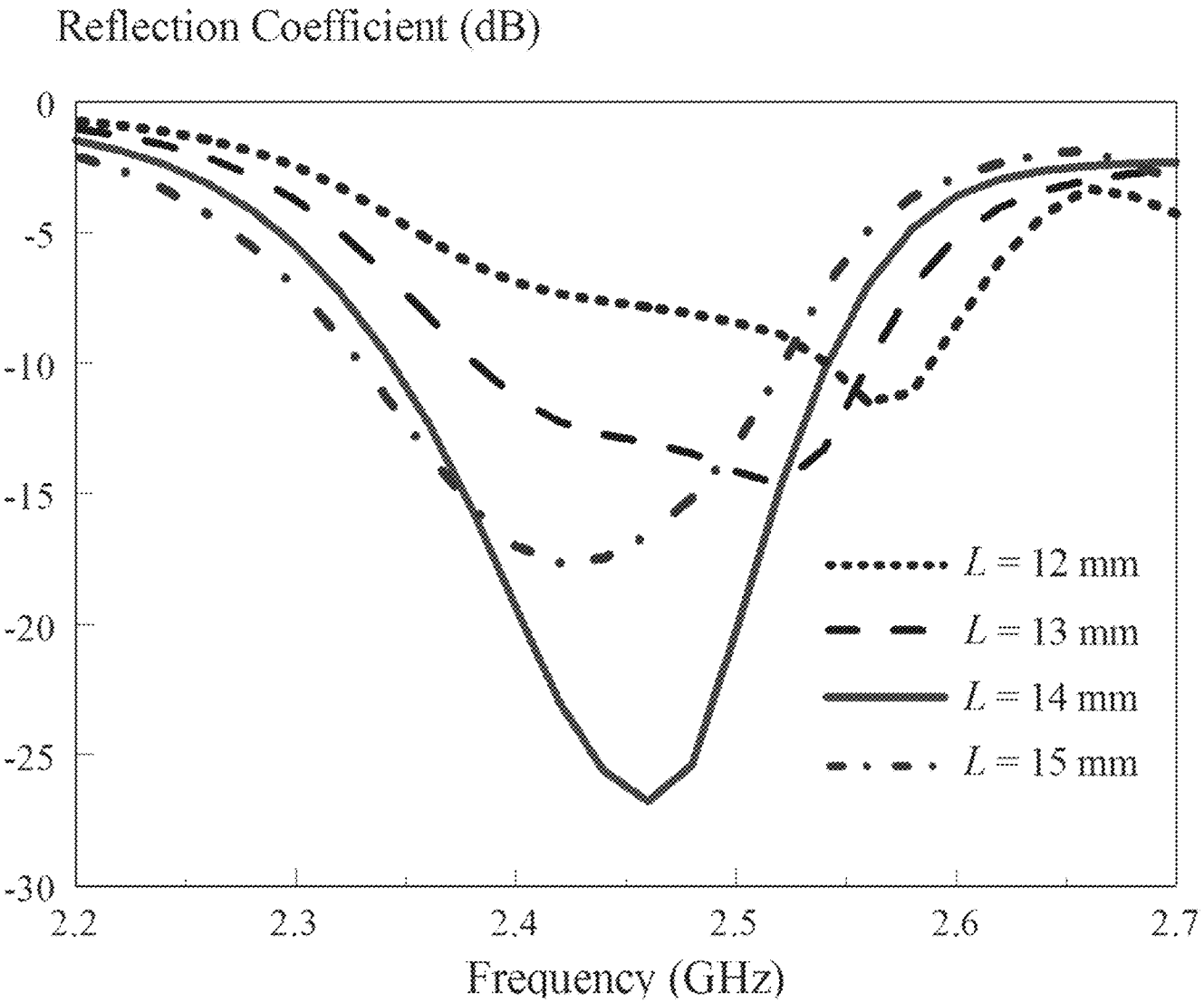
FIG. 2 is a plot showing simulated reflection coefficients of the antenna assembly of FIG. 1 with different slot lengths of L=12 mm, 13 mm, 14 mm, and 15 mm.

With reference to FIG. 2, there is shown the simulated reflection coefficients in relation to varied slot lengths in the antenna body 102. In this analysis, the slot lengths are varied with a step of 1 mm. When L=13 mm and 12 mm, two resonances may be observed. As the increase of L, the first resonance changes little, but the second resonance moves to lower frequency. This indicates that the second resonance occurs due to the slot. It was also found that only the first resonance is shown and the resonant frequency changes little if the slot length L is larger than 14 mm. This may indicate that the first resonance is not caused by the slot, but the slot length may be used to tune the impedance matching.

Figure 3:
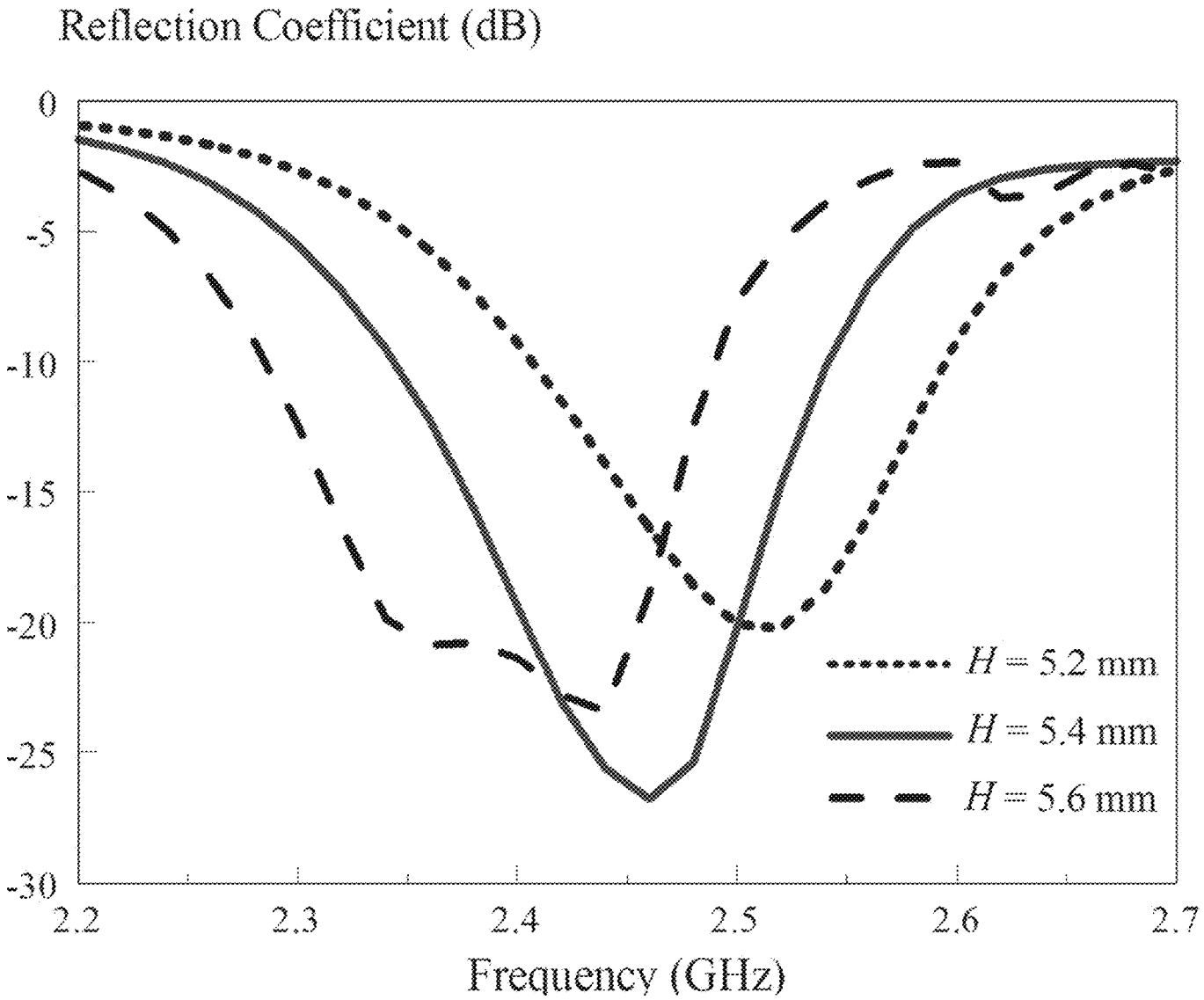
FIG. 3 is a plot showing simulated reflection coefficients of the antenna assembly of FIG. 1 with different DR heights of H=5.2 mm, 5.4 mm, and 5.6 mm.

With reference to FIG. 3, there is shown the simulated reflection coefficients in relation to varied height of the antenna body 102. In this analysis, the DRA height is changed with different values of H=5.2 mm, 5.4 mm, and 5.6 mm. A significant impedance passband shift may be observed, indicating the resonant mode is a DR mode. When H is 5.6 mm, two resonances are also found in the reflection coefficient. According to the parametric study of L above, the first and second resonance are the DR and slot modes, respectively.

Figure 4:
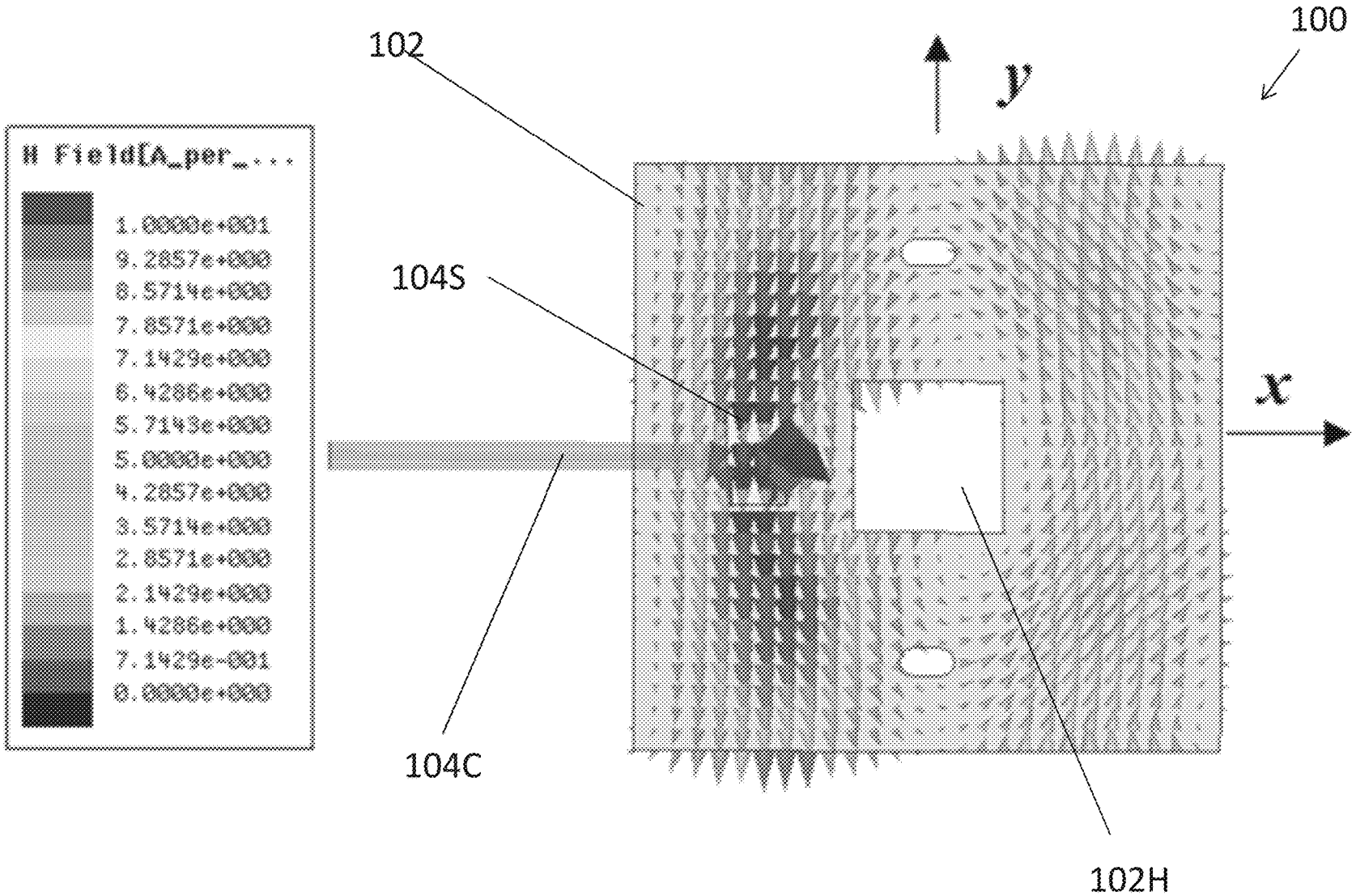
FIG. 4 is a color plot showing simulated H-field in the xy-plane of the antenna assembly of FIG. 1 without a central switch button.

With reference to FIG. 4, there is shown a plot showing the H-field in azimuthal (xy-) plane inside the DR or the antenna body 102 for identifying the DRA mode. In this analysis, the field is similar with that produced by two opposite short magnetic dipoles, and can be identified as a DR $TE_{2\delta 1}^{y}$ mode of an electromagnetic wave.

Alternatively the antenna is arranged to radiate an electromagnetic radiation of other forms, such as but not limited to a broadside, an endfire, an omnidirectional and a conical-beam radiation pattern, or the antenna may operate as a non-resonant-type antenna.

Figure 5A:
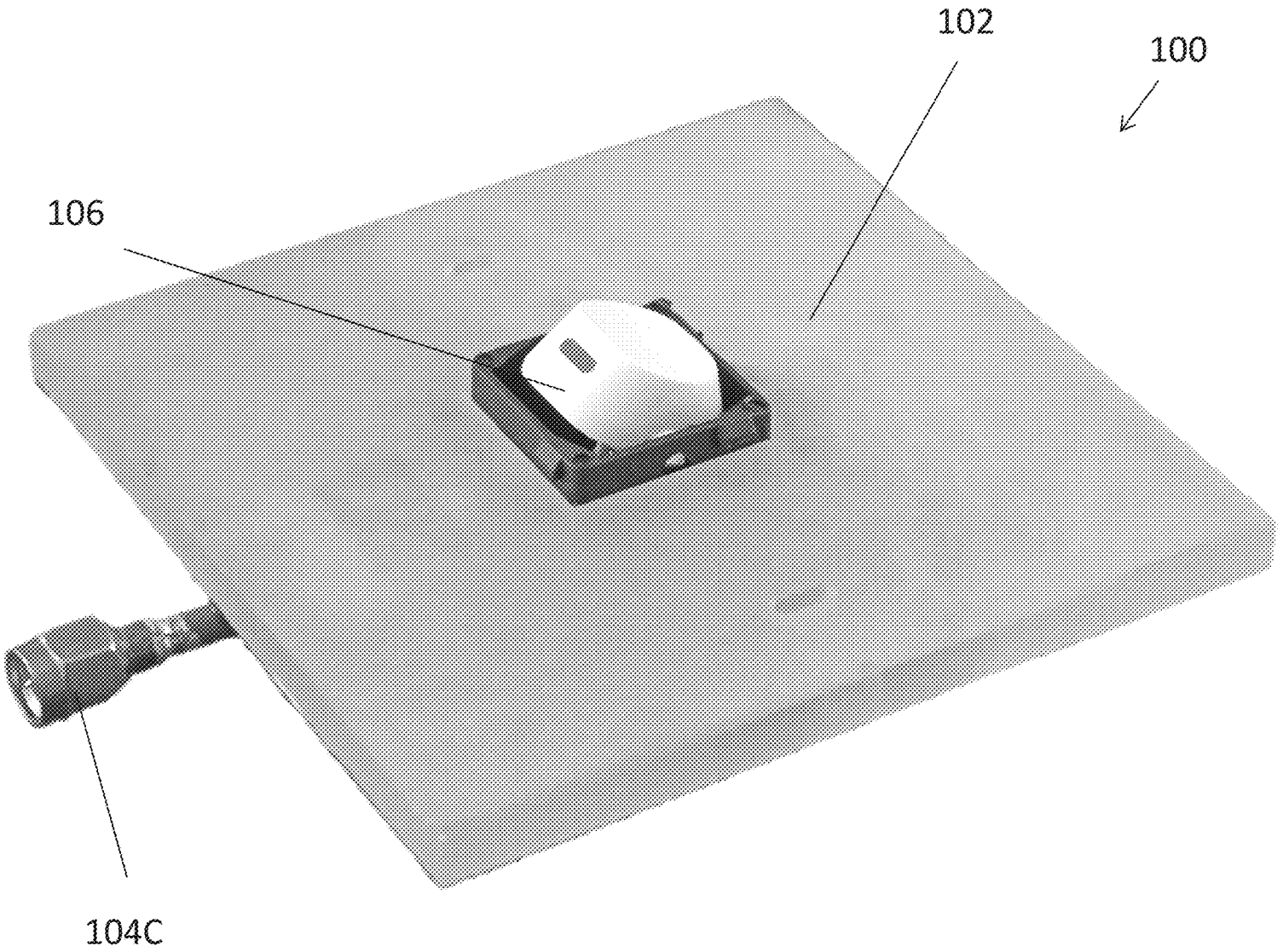
FIGS. 5A and 5B are photographic images showing a perspective view and a side view of a fabricated antenna assembly of FIG. 1.
Figure 5B:
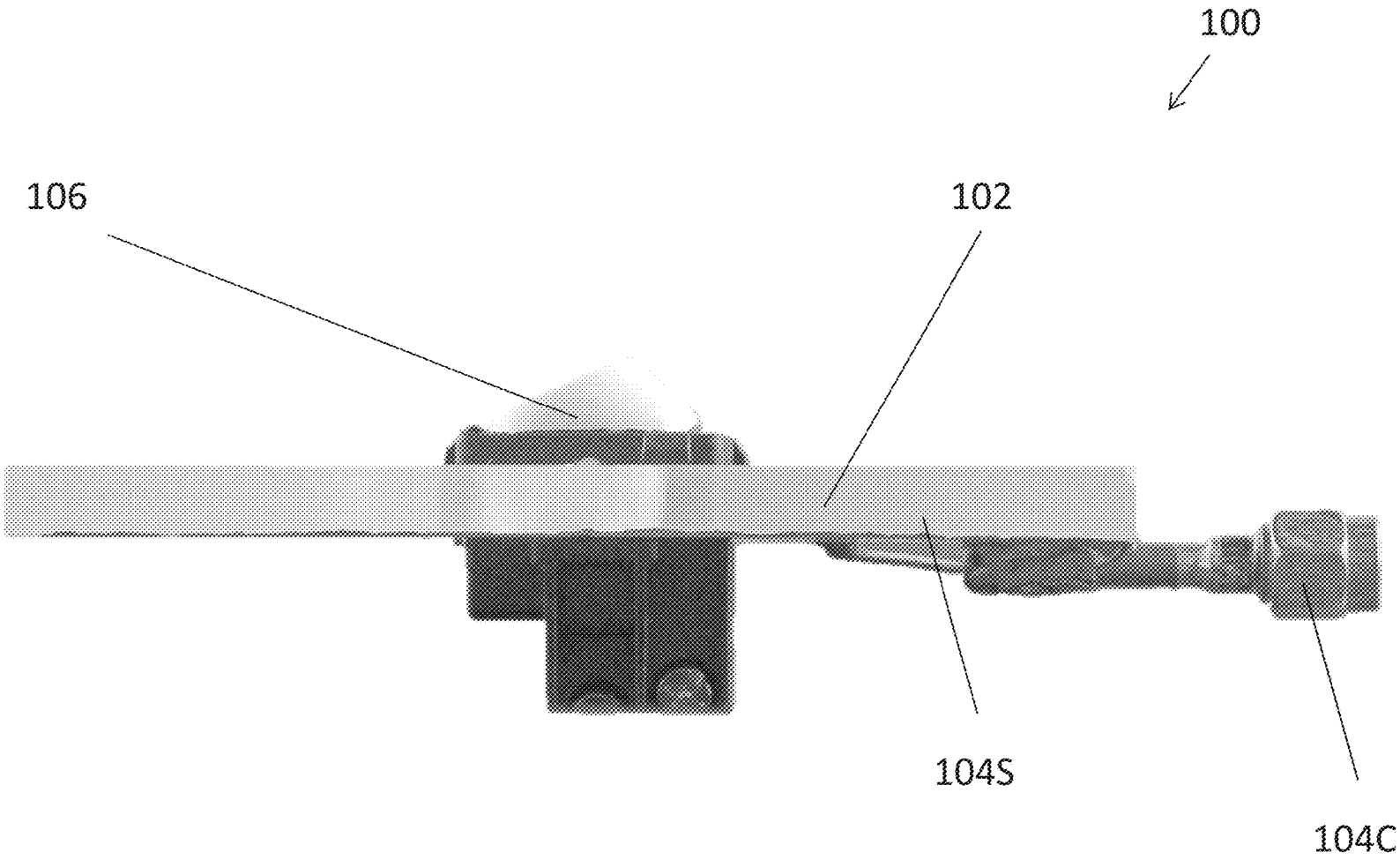

With reference to FIGS. 5A and 5B, a switch DRA 100 was fabricated in accordance with an embodiment of the present invention, and the performance of the antenna assembly 100 was analysed and compared with the simulation results.

Figure 6:
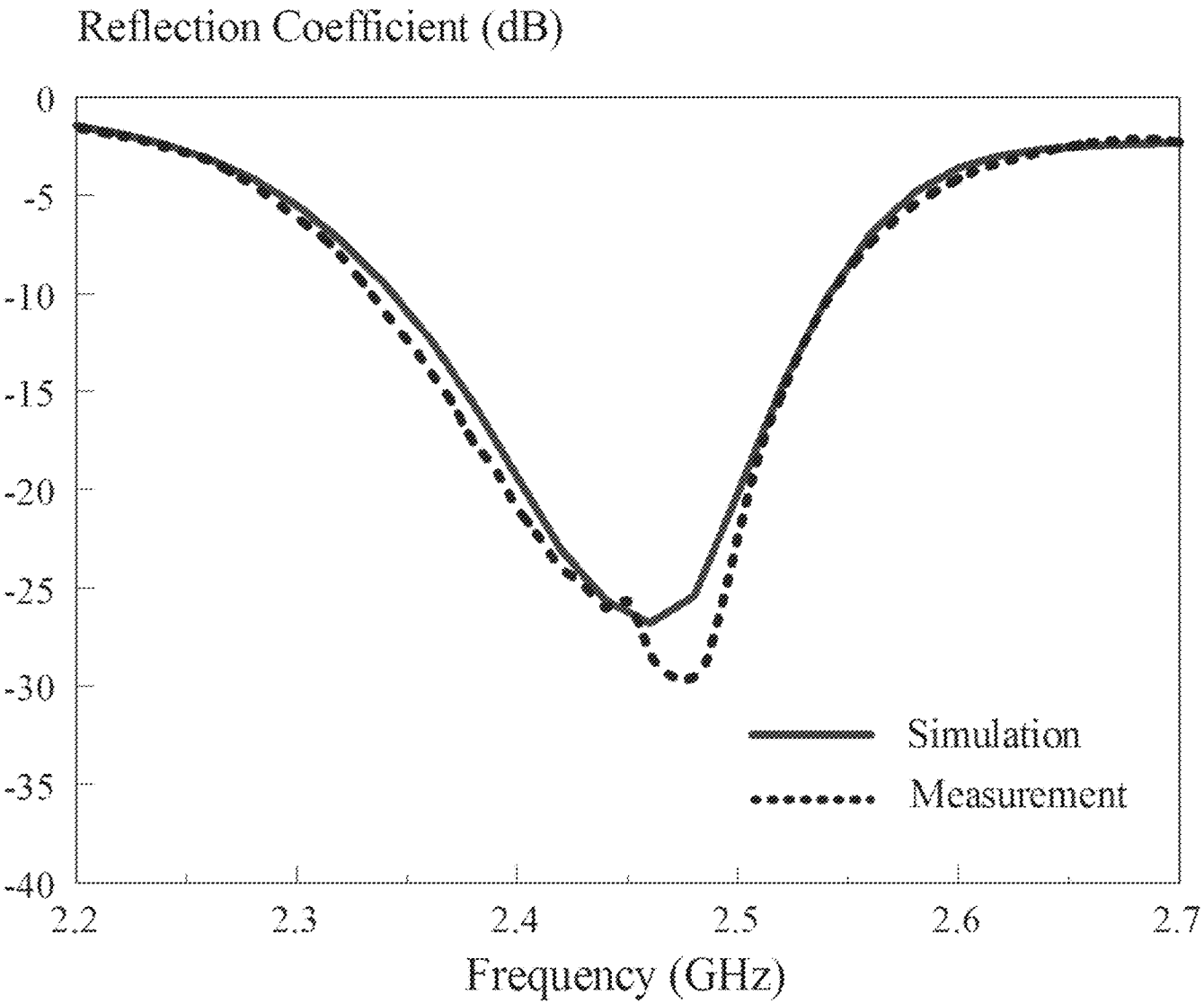
FIG. 6 is a plot showing simulated and measured reflection coefficients of the antenna assembly of FIG. 5: a=86 mm, $\varepsilon_r$=28, H=5.4 mm, $L_1$=22 mm, $l_p$=25 mm, L=14 mm, W=8 mm.

With reference to FIG. 6, there is shown the simulated and measured reflection coefficients of switch DRA or the antenna assembly 100. The simulation results generally agreed with the measurement results. As shown in the plot. The simulated and measured resonant frequencies are 2.46 GHz and 2.47 GHz, respectively. The measured impedance bandwidth is 8.2% (2.34-2.54 GHz), slightly larger than the simulated result of 7.8% (2.35-2.54 GHz). This may be reasonable due to the experimental imperfection. Both the simulated and measured impedance bandwidths are sufficient for WLAN band applications (3.3%).

Figures 7A, 7B:
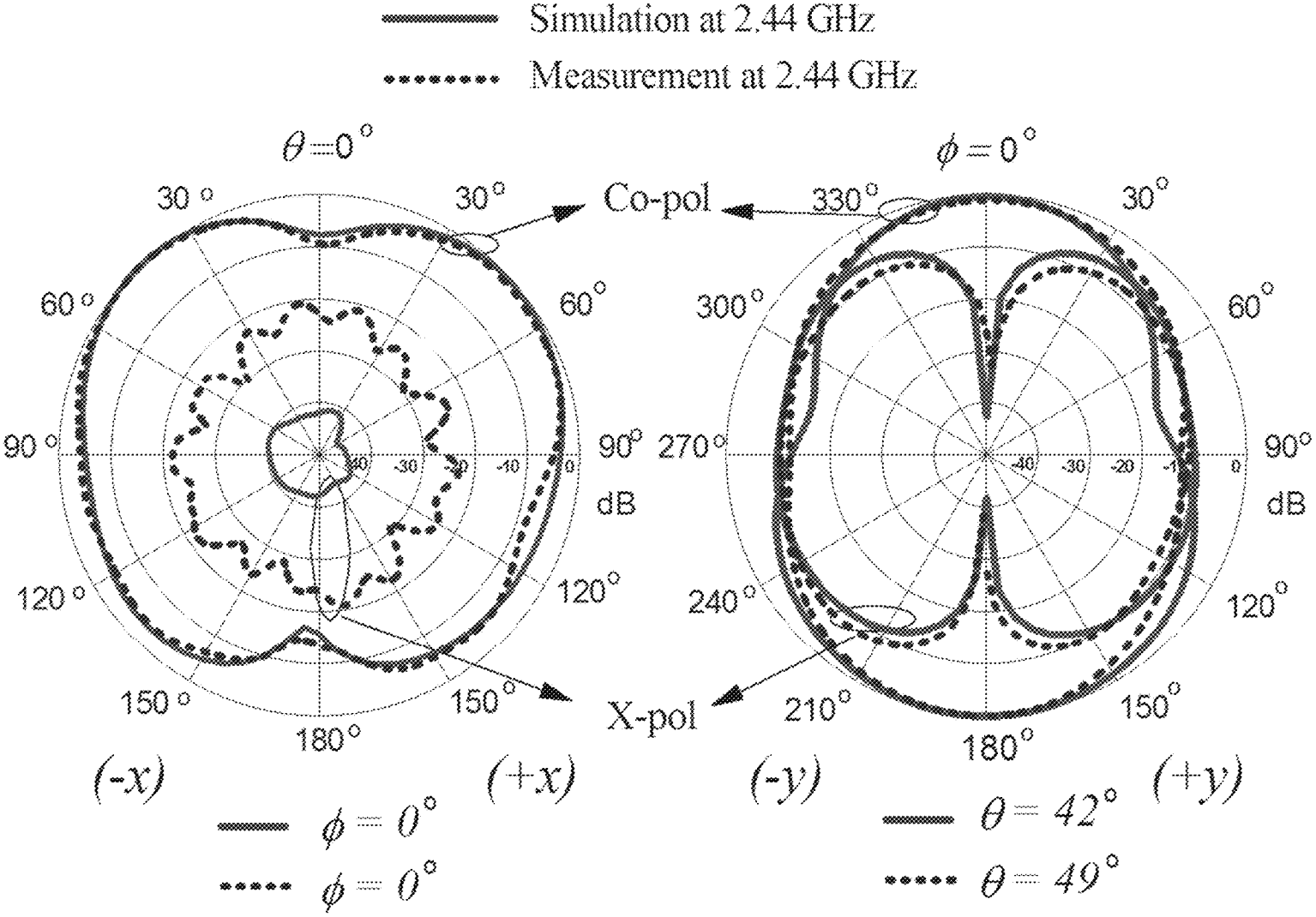
FIGS. 7A and 7B are plots showing simulated and measured radiation patterns of the antenna assembly of FIG. 5 in an elevation (xz-) plane ($\phi$=0°) and a horizontal plane: $\theta$=42° (simulation) and $\theta$=49° (measurement) respectively.

With reference to FIGS. 7A and 7B, there is shown the simulated and measured results of the antenna assembly 100 including radiation patterns in two orthogonal planes at 2.44 GHz, and the results show a reasonable consistency between them.

Referring to FIG. 7A, the results relate to the far-field patterns in the elevation (xz-) plane (ϕ=0°). The simulated (5.39 dBi) and measured maximum gains (4.59 dBi) show at θ=42° and θ=49°, respectively. The slight difference can be also due to the experimental imperfection.

Referring to FIG. 7B, the results relate to the radiation patterns in the horizontal planes including maximum gains are presented, namely, θ=42° (simulation) and θ=49° (measurement). It can be observed that both simulated and measured patterns have higher gains at ϕ=180° than those at ϕ=0°. This is reasonable because the off-set feeding slot locates at −x axis. As the switch DRA is mainly used in household applications, the requirement for pattern shape can be relaxed.

Figure 8:
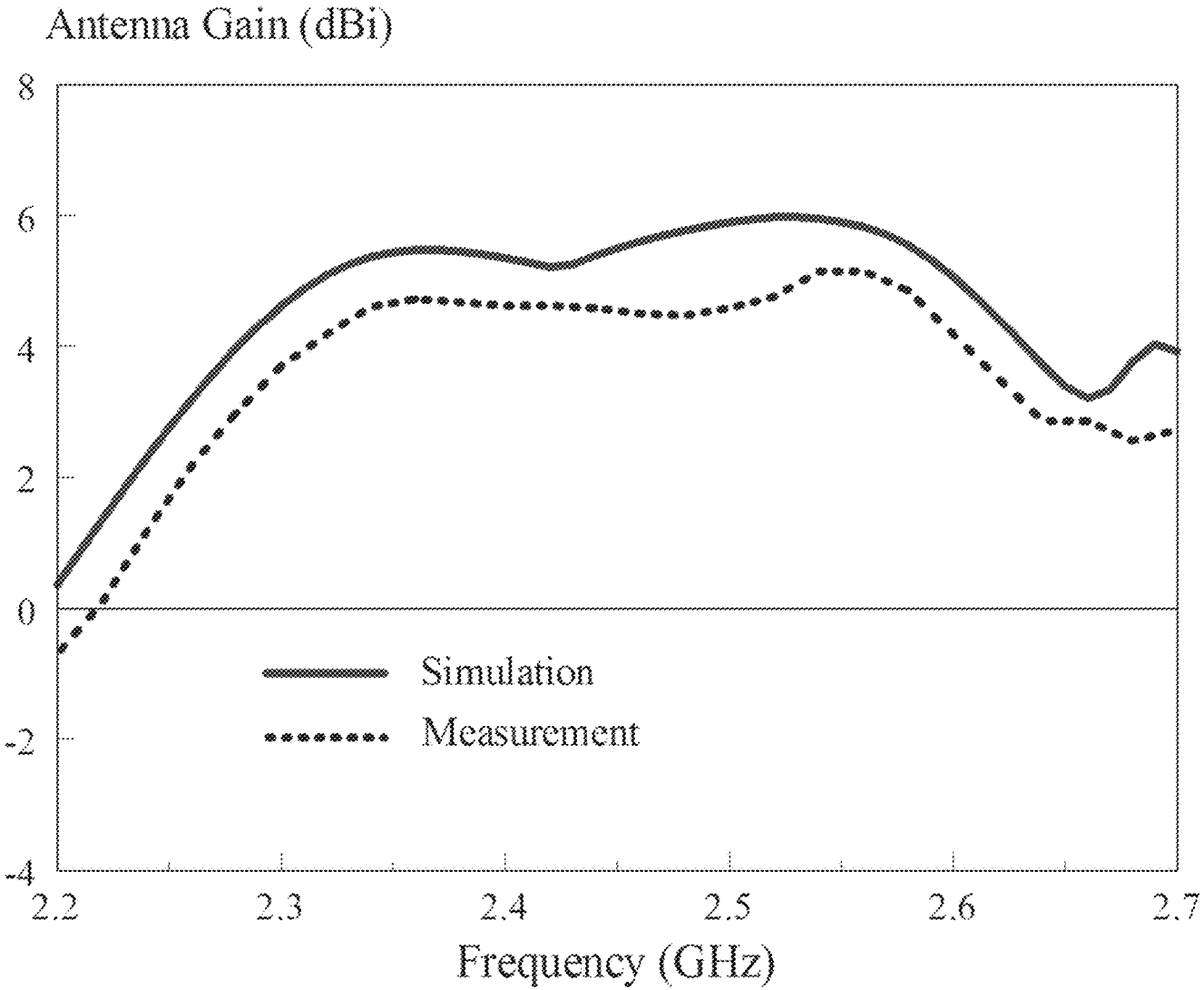
FIG. 8 is a plot showing simulated and measured peak antenna gains of the antenna assembly of FIG. 5.

With reference to FIG. 8, there is shown the simulated and measured peak antenna gains. Again, reasonable agreement is shown between the simulation and measurement. Referring to the figure, the simulated and measured peak gains over respective impedance bandwidth are 5.97 dBi (2.53 GHz) and 5.15 dBi (2.54 GHz), respectively. The lower measured antenna gain is reasonable considering the dielectric and metallic loss.

Figure 9:
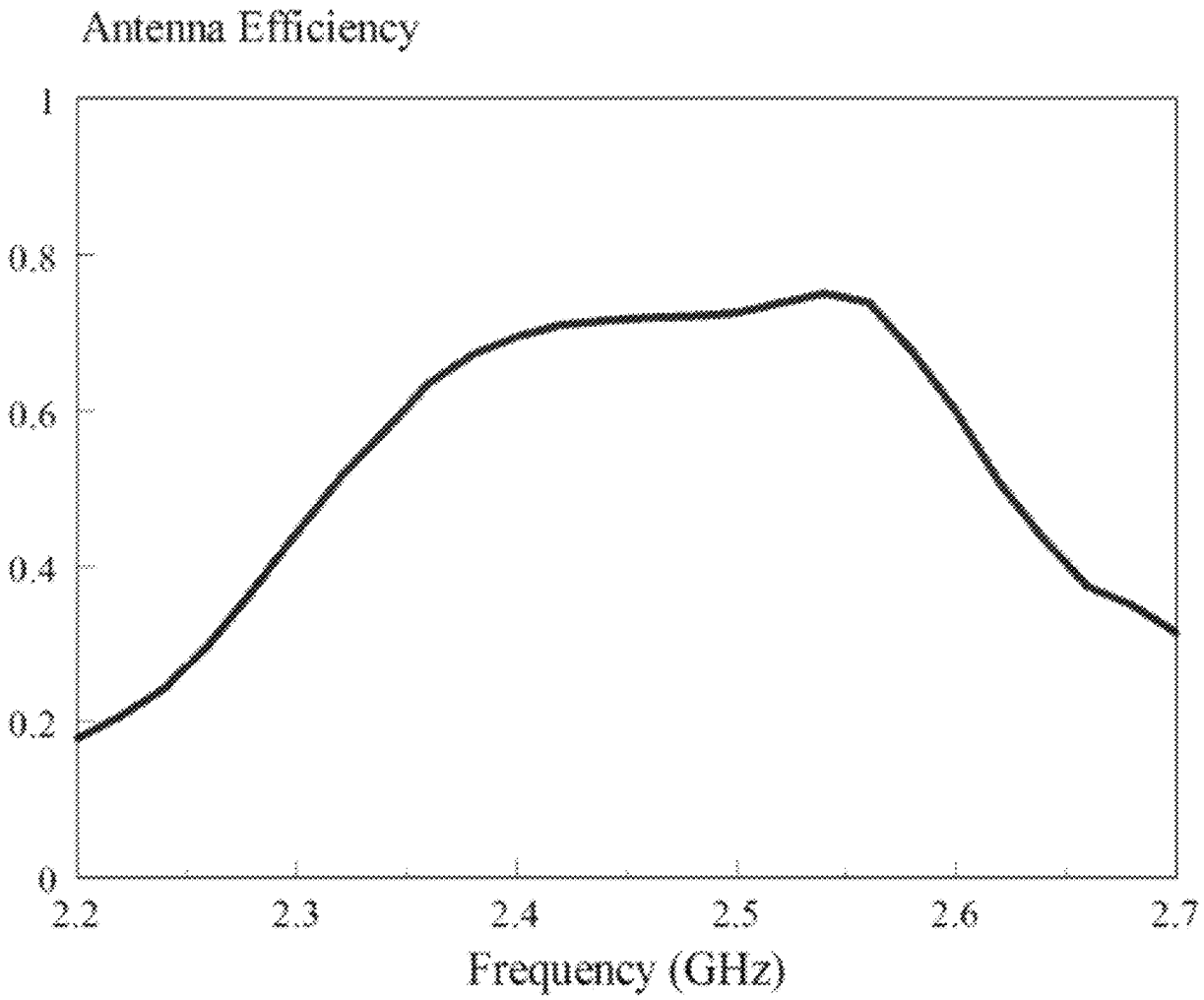
FIG. 9 is a plot showing measured antenna efficiency of the antenna assembly of FIG. 5.

With reference to FIG. 9, there is shown the measured total antenna efficiency. Across the measured impedance bandwidth, the maximum and minimum antenna efficiencies are 75.1% and 63.6%, respectively.

These embodiments may be advantageous in that the antenna assembly may be used as a dual-function antenna which may also operate as a switch panel. It may be designed with a dimension according to the some existing switch panel in the market, but the antenna body may be made of zirconia material for its transparency.

Through the parametric studies, it was found that the DR height and slot length may be fine-tuned for different purposes or requirements, and these parameters may be used to determine the operating frequency band and adjust impedance bandwidth, respectively.

The inventors also found that the antenna assembly or the switch DRA may be designed at WLAN band (2.4-2.48 GHz). In the performance evaluation performed, the antenna assembly may have an impedance bandwidth of 8.2%, which is sufficient for the WLAN band (3.3%). Across the measured impedance bandwidth (2.34-2.54 GHz), the measured antenna gain is larger than 4.47 dBi with a peak value of 5.15 dBi. The total antenna efficiency is also measured with a maximum value of 75.1%. It was found the radiation pattern has a dip at the boresight direction due to the field distribution of DR $TE_{2\delta 1}^{y}$.

A slight asymmetry also shows in the radiation patterns, resulting from the off-center located feeding slot. Advantageously, the switch panel may be used in household or office environment, as the requirement for radiation patterns may be relaxed in indoor communication.

In addition, the dual functional DRA is transparent, therefore may be used in functional modules including indicators or illuminations. For example, the switch panel may be designed to illuminate a dimmed light signal through the transparent DR block to indicate its position in when the in-room lighting is switched off.

Advantageously, antennas in accordance with these embodiments may be incorporated into practical home appliance. For example, a switch panel can be used as dielectric antennas. Such technique can be used to camouflage antennas by turning them into home appliance such as a socket panel, a ceiling mounted light, etc.

By integrating other types of functional circuits or modules, the antenna assembly may be used in other intelligent home or office appliance. For example, the antenna assembly may be embedded in the switch panels for controlling curtains, doors, TV, light in a room. The transparent material may make the appearance of wireless systems aesthetic and attractive.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. An antenna assembly comprising an dielectric resonator antenna including a dielectric resonator antenna body and a slot feeder, and at least one functional module arranged to operate with a function different from that provided by the dielectric resonator antenna; wherein the at least one functional module includes at least one electrical switch mounted in a respective aperture defined on the dielectric resonator antenna body, such that the dielectric resonator antenna body and the at least one electrical switch combine to operate as an electrical switch panel, the at least one electrical switch is arranged to control a supply of electricity to an electrical apparatus in electrical connection with the at least one electrical switch, and the dielectric resonator antenna is operable to radiate a communication signal to an external communication device.

2. The antenna assembly in accordance with claim 1, wherein the dielectric resonator antenna is arranged to operate in a dielectric resonator $TE_{2\delta 1}{}^{y}$ mode.

3. The antenna assembly in accordance with claim 1, wherein the dielectric resonator antenna is arranged to radiate an electromagnetic radiation including at least one of a broadside, an endfire, an omnidirectional and a conical-beam radiation pattern.

4. The antenna assembly in accordance with claim 1, wherein the dielectric resonator antenna includes a non-resonant-type antenna.

5. The antenna assembly in accordance with claim 1, wherein the functional module is physically connected to the dielectric resonator antenna body.

6. The antenna assembly in accordance with claim 5, wherein the at least one aperture defined on the dielectric resonator antenna body is further arranged to at least partially accommodate or encompass the functional module.

7. The antenna assembly in accordance with claim 1, wherein the dielectric resonator antenna body is a rectangular block of dielectric material.

8. The antenna assembly in accordance with claim 7, wherein the dielectric material includes zirconia.

9. The antenna assembly in accordance with claim 7, wherein the dielectric material includes at least one of silicon dioxide, acrylic and porcelain.

10. The antenna assembly in accordance with claim 1, wherein the dielectric resonator antenna body is at least partially transparent.

11. The antenna assembly in accordance with claim 1, wherein the slot feeder comprises a feeding slot structure defined on the dielectric resonator antenna body.

12. The antenna assembly in accordance with claim 11, wherein the feeding slot structure is defined in a positioned shifted from a center position of the dielectric resonator antenna body.

13. The antenna assembly in accordance with claim 11, wherein the slot feeder further comprises a microstripline or coaxial feedline adjacent to the feeding slot structure.

14. The antenna assembly in accordance with claim 1, wherein the slot feeder includes at least one of a probe feed, a direct microstrip feedline, a coplanar feed, a dielectric image guide, a metallic waveguide and a substrate-integrated waveguide.

15. The antenna assembly in accordance with claim 1, wherein the dielectric resonator antenna further comprises a ground plane adjacent to the dielectric resonator antenna body.

16. The antenna assembly in accordance with claim 15, wherein the ground plane includes an electrical conductive sheet connected to the dielectric resonator antenna body.

17. The antenna assembly in accordance with claim 16, wherein the dielectric resonator antenna further comprises a ground plane adjacent to the dielectric resonator body.

18. The antenna assembly in accordance with claim 1, wherein the dielectric resonator antenna body is arranged to form a part of an electrical apparatus.

19. The antenna assembly in accordance with claim 18, wherein the electrical apparatus includes an intelligent home or office appliance.

20. The antenna assembly in accordance with claim 18, wherein the electrical apparatus includes a wireless-communication-enabled device.

21. A wireless-communication-enabled device, comprising an antenna assembly in accordance with claim 1, wherein the dielectric resonator antenna is arranged to facilitate a communication between the external communication device and the wireless-communication-enabled device.

22. An intelligent home or office appliance, comprising the wireless-communication-enabled device in accordance with claim 20 or the antenna assembly in accordance with claim 1.

* * * * *